US005202224A

United States Patent [19]

Yamakawa et al.

[11] Patent Number: 5,202,224

[45] Date of Patent: Apr. 13, 1993

[54] DYE-FORMING COUPLER, A SILVER HALIDE COLOR PHOTOGRAPHIC MATERIAL USING SAME, AND A METHOD FOR PROCESSING THE SILVER HALIDE COLOR PHOTOGRAPHIC MATERIAL

[75] Inventors: Katsuyoshi Yamakawa; Hideaki Naruse, both of Minami-ashigara, Japan

[73] Assignee: Fuji Photo Film Co., Ltd., Kanagawa, Japan

[21] Appl. No.: 638,810

[22] Filed: Jan. 8, 1991

[30] Foreign Application Priority Data

Jan. 9, 1990 [JP] Japan ..... 2-919

[51] Int. Cl.[5] ..... G03C 7/38

[52] U.S. Cl. ..... 430/558; 430/384; 430/385

[58] Field of Search ..... 430/558, 384, 385

[56] References Cited

U.S. PATENT DOCUMENTS 2,293,004 8/1942 Lohaus ..... 430/558
3,293,032 12/1966 Jaeken et al. ..... 430/558

FOREIGN PATENT DOCUMENTS 473613 5/1951 Canada ..... 430/558
0333185 9/1989 European Pat. Off. ..... 430/558

*Primary Examiner*—Lee C. Wright

*Attorney, Agent, or Firm*—Birch, Stewart, Kolasch & Birch

[57] ABSTRACT

There is disclosed a novel dye-forming coupler, a silver halide color photographic material using the same, and a method for processing the silver halide color photographic material, wherein the dye-forming coupler is a cyan dye-forming coupler represented by formula (I), the silver halide color photographic material comprises the coupler represented by formula (I) in at least one of its photosensitive layers, and the method for processing the silver halide color photographic material comprises a color-developing process using a color developer substantially free from benzyl alcohol. The disclosure described provides a silver halide color photographic material whose color image is fast to light, heat, and humidity and whose color reproduction is excellent.

Formula (I)

wherein H—Z— represents an unsubstituted amino group or an aliphatic amino, aromatic amino, or heterocyclic amino group, which may be substituted, $R^1$ and $R^2$ each represent an electron-donating group, $R^3$ represents a substituent, l and m each are 0 or 1, provided that $l+m \geqq 1$, and n is an integer of 0 to 2.

18 Claims, 1 Drawing Sheet

DYE-FORMING COUPLER, A SILVER HALIDE COLOR PHOTOGRAPHIC MATERIAL USING SAME, AND A METHOD FOR PROCESSING THE SILVER HALIDE COLOR PHOTOGRAPHIC MATERIAL

FIELD OF THE INVENTION

The present invention relates to a novel cyan dye-forming coupler to be used in silver halide color photographic materials, etc., and to a silver halide photographic material containing the same.

BACKGROUND OF THE INVENTION

When a silver halide photographic material is exposed to light and then is subjected to a color-developing process, a developing agent, such as an aromatic primary amine derivative that has been oxidized with a silver halide, reacts with dye-forming couplers to form a color image. Generally, in this technique, the color reproduction method by the subtractive color process is often carried out, and in order to reproduce blue, green, and red, color images of yellow, magenta, and cyan, complementary respectively to blue, green, and red, are formed.

As cyan color image-forming couplers, phenols and naphthols are used in many cases. However, the preservability of color images obtained from phenols and naphthols that are conventionally used has some problems that remain unsolved. For example, color images obtained from 2-acylaminophenol cyan couplers described, for example, in U.S. Pat. Nos. 2,367,531, 2,369,929, 2,423,730, and 2,801,171, are generally poor in fastness to heat, color images obtained from 2,5-diacylaminophenol cyan couplers, described in U.S. Pat. No. 2,772,162 and 2,895,826, are generally poor in fastness to light, and 1-hydroxy-2-naphthamide cyan couplers are generally not adequate concerning both fastness to light and fastness to heat (particularly heat and humidity).

In order to overcome the defects of these cyan dye-forming couplers, for example, 5-hydroxy-6-acylaminocarbostyryl cyan couplers, described in U.S. Pat. Nos. 4,327,173 and 4,564,586, and 4-hydroxy-5-acylaminooxyindole couplers and 4-hydroxy-5-acylamino-2,3-dihydro-1,3-benzimidazol-2-one couplers, described in U.S. Pat. No. 4,430,423, are developed. These couplers are excellent concerning fastness to light and fastness to heat. Although these couplers are unique couplers having a hetero atom in the mother nucleus that will form a color, any of the rings having a dissociative group for color formation is equivalent to phenol.

Further, cyan dyes obtained from conventionally used phenols and naphthols have subsidiary absorption in the blue and green regions, and therefore are not preferable, particularly in view of the reproduction of green color, so that their improvement is desired.

On the other hand, concerning couplers that have a hetero atom introduced in a ring having a dissociative group, only 3-hydroxypyridine and 2,6-dihydroxypyridine are disclosed in U.S. Pat. No. 2,293,004. However, the absorption wavelength of the absorption obtained by 3-hydroxypyridine, described in tis U.S. Pat. No. 2,293,004, is extreme on the short wavelength side and the absorption peak is broad. Further, this 3-hydroxypyridine is soluble in water. Therefore, 3-hydroxypyridine cannot be used as a so-called cyan coupler Further, although pyridine-type cyan couplers having a dissociative group in the 3-position are disclosed in EP No. 0333185, a more improved one is desired in view of color-forming properties.

On the other hand, in recent years, in view of environmental pollution and solution preparation, color developers free from benzyl alcohol have come to be used, but with rapid processing using such color developers there is a problem that adequate color density cannot be obtained with these cyan couplers, and therefore new couplers that overcome these problems are desired.

SUMMARY OF THE INVENTION

Therefore, the first object of the present invention is to provide a novel cyan coupler excellent in fastness to light and fastness to heat as well as excellent in absorption characteristics of the color-formed dye (i.e., there is no subsidiary absorption in the blue and green regions, the absorption waveform is sharp, and color reproduction can be improved).

The second object of the present invention is to provide a silver halide photographic material that overcomes problems involved in prior dye-forming couplers and whose color image is fast to light, heat, humidity, etc., and that is excellent in color reproduction.

The third object of the present invention is to provide a silver halide photographic material whose dye-forming speed and maximum color density are high in color developers, and particularly high in color developers from which benzyl alcohol has been excluded, as well as to provide a method for processing a silver halide photographic material wherein if the silver halide photographic material is processed with a processing solution having bleaching power weak in oxidation power (e.g., a processing solution having bleaching power and containing EDTA iron(III) Na-salt or EDTA iron (III) $NH_4$-salt) or a fatigued processing solution, the density lowers little.

Other and further object, features and advantages of the invention will appear more evident from the following description taken in connection with the accompanying drawing.

DETAILED DESCRIPTION OF THE INVENTION

Figure 1:
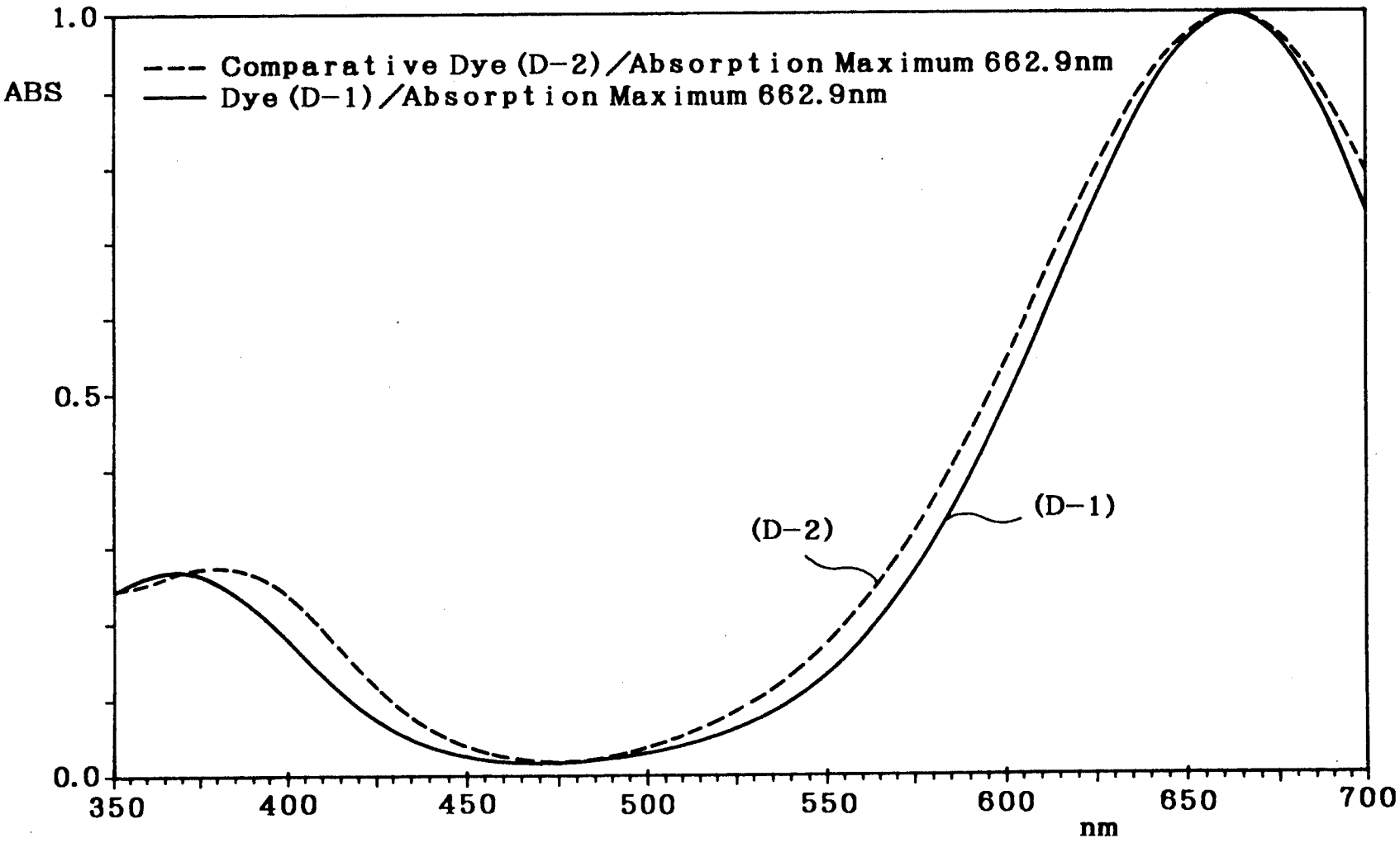
FIG. 1 is a diagram of the absorption spectra of dyes, wherein the absorbence is plotted along the ordinate and the absorption wave length (nm) is plotted along the abscissa.

The objects of the present invention have been attained by providing:

(1) a dye-forming coupler represented by the following formula (I):

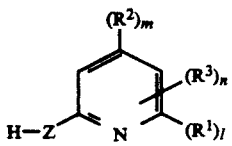

Formula (I)

wherein H—Z— represents an unsubstituted amino group or an aliphatic amino, aromatic amino, or heterocyclic amino group, which may be substituted, $R^1$ and $R^2$ each represent an electron-donating group, $R^3$ represents a substituent, l and m each are 0 or 1, provided that $l+m \geqq 1$, and n is an integer of 0 to 2;

(2) A silver halide color photographic material, characterized in that it contains at least one of dye-forming couplers defined under (1); and (3) A method for processing a silver halide color photographic material, characterized in that a silver halide color photographic material defined under (2) is processed with a color developer substantially free from benzyl alcohol.

The dye forming couplers of the present invention will now be described below.

In formula (I), H—Z— represents an unsubstituted amino group or an optionally substituted aliphatic amino group (preferably an aliphatic amino group having 1 to 36 carbon atoms, e.g., methylamino and propylamino), aromatic amino group (preferably an aromatic amino group having 6 to 36 carbon atoms, e.g., anilino and naphthylamino), or heterocyclic amino group (preferably 5- to 7-membered heterocyclic amino group, e.g., 3-pyridylamino and 2-furylamino), and these aliphatic, aromatic, and heterocyclic moieties may be substituted by a group selected from an alkoxy group (e.g., methoxy and 2-methoxyethoxy), an aryloxy group (e.g., 2,4-di-tertamylphenoxy, 2-chlorophenoxy, and 4-cyanophenoxy), an alkenyloxy group (e.g., 2-propenyloxy), an amino group (e.g., butylamino, dimethylamino, anilino, N-methylanilino), an acyl group (e.g., acetyl and benzoyl), an ester group (e.g., butoxycarbonyl, phenoxycarbonyl, acetoxy, benzoyloxy, butoxysulfonyl, and toluenesulfonyloxy), an amido group (e.g., acetylamino, ethylcarbamoyl, dimethylcarbamoyl, methanesulfonamido, and butylsulfamoyl), a sulfamido group (e.g., dipropylsulfamoylamino), an imido group (e.g., succinimido and hydantoinyl), an ureido group (e.g., phenylureido and dimethylureido), an aliphatic or aromatic sulfonyl group (e.g., methanesulfonyl and phenylsulfonyl), an aliphatic or aromatic thio group (e.g., ethylthio and phenylthio), a hydroxyl group, a cyano group, a carboxyl group, a nitro group, and a halogen atom.

In this specification and claims, by "aliphatic group" is meant a straight-chain, branched, or cyclic aliphatic hydrocarbon group including saturated and unsaturated ones such as an alkyl group, an alkenyl group, and an alkynyl group. As typical examples thereof, methyl, ethyl, butyl, dodecyl, octadecyl, eicosenyl, isopropyl, tert-butyl, tert-octyl, tert-dodecyl, cyclohexyl, cyclopentyl, allyl, vinyl, 2-hexadesenyl, and propargyl groups can be mentioned.

In formula (I), $R^1$ and $R^2$ each independently represent an electron-donating group, preferably at least one of $R^1$ and $R^2$ represents a substituent having a Hammett's substituent constant value $\sigma_p$ of $-0.25$ or below, preferably $-0.50$ or below. As the value of Hammett's substituent constant $\sigma_p$, values described in a report by Hansch, C. Leo (e.g., J. Med. Chem. 16, 1207 (1973); ibid. 20 304 (1977)) are preferably used.

As substituents whose $\sigma_p$ value is $-0.25$ or below, for example a substituted or unsubstituted amino group (e.g., amino, hydroxylamino, ethylamino, dimethylamino, butylamino, and anilino), a ureido group (e.g., 3-ethylureido), and an imino group (e.g., benzylideneamino), an alkoxy group (e.g., methoxy, propoxy, butoxy, and amyloxy), a hydroxyl group, and a hydrazino group can be mentioned and as substituents whose $\sigma_p$ value is $-0.5$ or below, for example a substituted or unsubstituted amino group (e.g., amino, methylamino, ethylamino, dimethylamino, and butylamino), an imino group (e.g., benzylideneamino), and a hydrazino group can be mentioned.

In formula (I), $R^3$represents, for example, a halogen atom, an aliphatic group preferably having 1 to 36 carbon atoms, an aromatic group preferably having 6 to 36 carbon atoms (e.g., phenyl and naphthyl), a heterocyclic group (preferably 5- to 7-membered heterocyclic group, e.g., 3-pyridyl and 2-furyl), an alkoxy group (e.g., methoxy and 2-methoxyethoxy), an aryloxy group (e.g., 2,4-di-tertamylphenoxyl, 2-chlorophenoxy, 4-cyanophenoxy), an alkenyloxy group (e.g., 2-propenyloxy), an amino group (e.g., butylamino, dimethylamino, anilino, and N-methylanilino), an acyl group (e.g., acetyl and benzoyl), an ester group (e.g., butoxycarbonyl, phenoxycarbonyl, acetoxy, benzoyloxy, butoxysulfonyl, and toluenesulfonyloxy), an amido group (e.g., acetylamino, ethylcarbamoyl, dimethylcarbamoyl, methanesulfonamido, and butylsulfamoyl), a sulfamido group (e.g., dipropylsulfamoylamino), an imido group (e.g., succinimido and hydantoinyl), a ureido group (e.g., phenylureido and dimethylureido), an aliphatic or aromatic sulfonyl group (e.g., methanesulfonyl and phenylsulfonyl), an aliphatic or aromatic thio group (e.g., ethylthio and phenylthio), a hydroxyl group, a cyano group, a carboxyl group, a nitro group, or a sulfo group. Of these groups, substituted or unsubstituted phenyl group, alkyl group, alkylamino group, and phenylamino (alinino) group are preferable.

The coupler of the present invention represented by formula (I) will react with the oxidized product of a primary amine developing agent to form a cyan dye whose absorption maximum is in the range of 580 to 710 nm (solvent: methanol).

The coupler represented by formula (I) is more preferably represented by formula (II):

Formula (II)

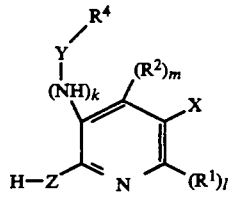

wherein $R^1$, $R^2$, H—Z—, l, and m have the same meaning as defined in formula (I), k is 0 or 1, Y represents —CO— or $SO_2$—, $R^4$ represents an aliphatic group, an aromatic group, a heterocyclic group, an amino group, an aliphatic amino group, an aromatic amino group, an aliphatic oxy group, or an aromatic oxy group, and X represents a hydrogen atom or a group capable of being released upon coupling reaction with the oxidized product of a developing agent.

In formula (II), $R^4$ represents preferably an aliphatic group having preferably 1 to 36 carbon atoms (e.g., methyl, ethyl, and phenetyl), an aromatic group having 6 to 36 carbon atoms (e.g., phenyl and naphthyl), a heterocyclic group (preferably 5- to 7-membered heterocyclic group, e.g., 3-pyridyl and 2-furyl), an amino group, an aliphatic amino group (e.g., butylamino and octylamino), an aromatic amino group (e.g., anilino and p-methoxyanilino), an aliphatic oxy group (e.g., methoxy, ethoxy, and i-butoxy), or an aromatic oxy group (e.g., phenoxy), which may be substituted by a group selected from an alkoxy group (e.g., methoxy and 2-methoxyethoxy), an aryloxy group (e.g., 2,4-di-tert-amylphenoxy, 2-chlorophenoxy, 4-cyanophenoxy), an alkenyloxy group (e.g., 2-propenyloxy), an amino group (e.g., butylamino, dimethylamino, anilino, and N-methylanilino), an acyl group (e.g., acetyl and benzoyl), an ester group (e.g., butoxycarbonyl, phenoxycarbonyl, acetoxy, benzoyloxy, butoxysulfonyl, and toluenesulfonyloxy), an amido group (e.g., acetylamino, ethylcarbamoyl, dimethylcarbamoyl, methanesulfonamido, and butylsulfamoyl), a sulfamido group (e.g., dipropylsulfamoylamino), an imido group (e.g., succinimido and hydantoinyl), a ureido group (e.g., phenylureido and dimethylureido), an aliphatic or aromatic sulfonyl group (e.g., methanesulfonyl and phenylsulfonyl), an aliphatic or aromatic thio group (e.g., ethylthio and phenylthio), a hydroxyl group, a cyano group, a carboxyl group, a nitro group, a sulfo group, a halogen atom, etc. $R_4$ is preferably an unsubstituted or substituted phenyl, alkyl, alkylamino or phenylamino group.

X represents a hydrogen atom or a group capable of being released upon coupling reaction (hereinafter referred to as a group capable of being released).

Specific examples of the group capable of being released upon a coupling reaction includes a halogen atom (e.g. fluorine, chlorine, and bromine), an alkoxy group (e.g., ethoxy, dodecyloxy, methoxyethylcarbamoylmethoxy, carboxypropyloxy, and methylsulfonylethoxy), an aryloxy group (e.g., 4-chlorophenoxy, 4-methoxyphenoxy, and 4-carboxyphenoxy), an acyloxy group (e.g., acetoxy, tetradecanoyloxy, and benzoyloxy), an aliphatic or aromatic sulfonyloxy group (e.g., methanesulfonyloxy and toluenesulfonyloxy), an acylamino group (e.g., dichloroacetylamino and heptafluorobutyrylamino), an aliphatic or aromatic sulfonamido group (e.g., methanesulfonamido and p-toluenesulfonamido), an alkoxycarbonyloxy group (e.g., ethoxycarbonyloxy and benzyloxycarbonyloxy), an aryloxycarbonyloxy group (e.g., phenoxycarbonyloxy), an aliphatic, aromatic or heterocyclic thio group (e.g., ethylthio, phenylthio, and tetrazolylthio), a carbamoylamino group (e.g., N-methylcarbamoylamino and N-phenylcarbamoylamino), a 5- or 6-membered nitrogen-containing heterocyclic group (e.g., imidazolyl, pyrazolyl, triazolyl, tetrazolyl, and 1,2-dihydro-2-oxy-1-pyridyl), an imido group (e.g., succinimido and hydantoinyl), and an aromatic azo group (e.g., phenylazo), which may be substituted by a group that is allowed as a substituent of $R^3$. As groups capable of being released upon a coupling reaction bonded through a carbon atom, there are bis-type couplers which are also included and which are obtained by condensing 4-equivalent couplers with aldehydes or ketones. The group capable of being released upon a coupling reaction of the present invention may include a photographically useful group such as a development inhibitor and a development accelerator.

In formula (II), more preferably X represents a hydrogen atom, a halogen atom, an aliphatic or aromatic oxy group, an aliphatic or aromatic thio group, an aliphatic or aromatic oxycarbonyloxy group, an aliphatic or aromatic carbonyloxy group, or an aliphatic or aromatic sulfonyloxy group.

In formula (II), m is preferably 0 and l is preferably 1.

Specific examples of the couplers of the present invention are listed below, but the present invention is not limited by them:

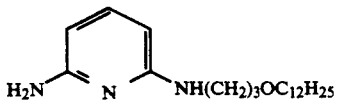

(1)

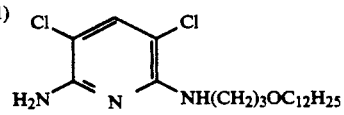

(2)

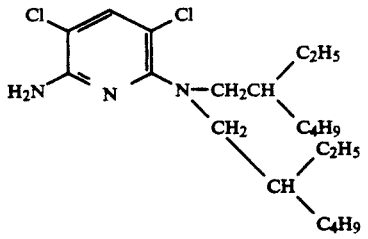

(3)

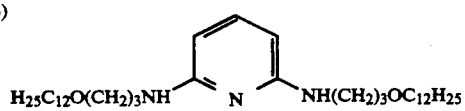

(4)

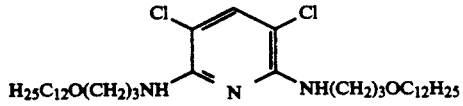

(5)

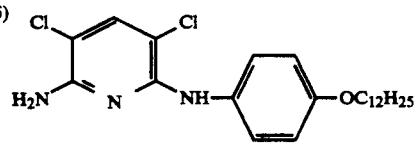

(6)

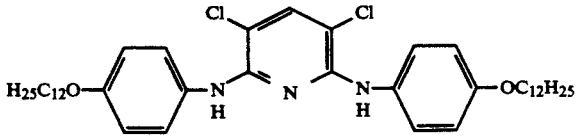

(7)

-continued
(8)
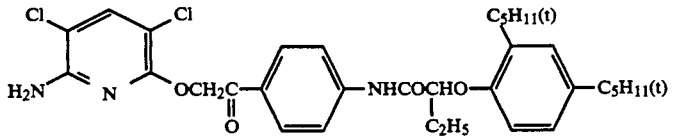
(9)
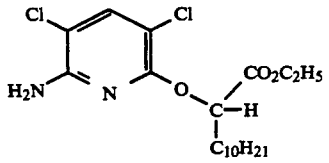
(10)
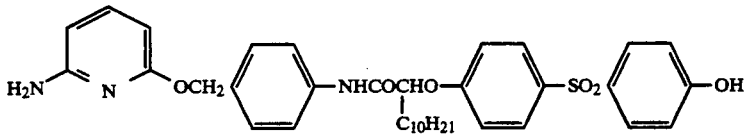
(11)
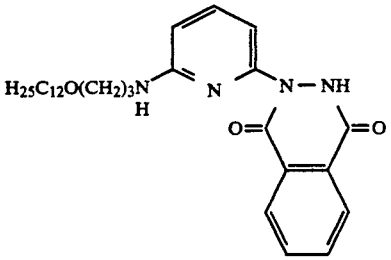
(12)
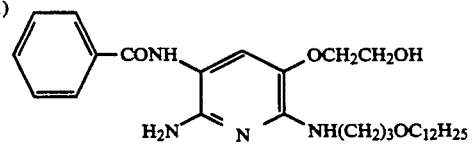
(13)
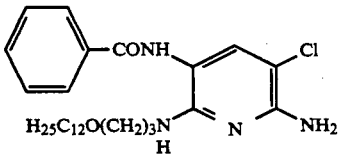
(14)
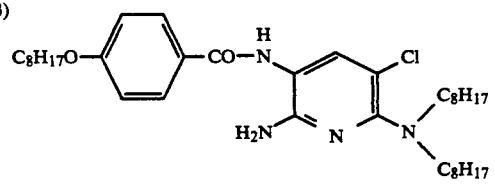
(15)
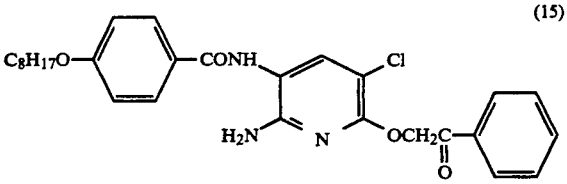
(16)
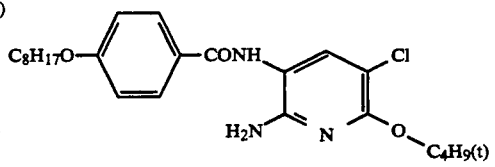
(17)
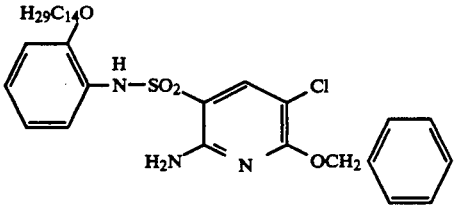
(18)
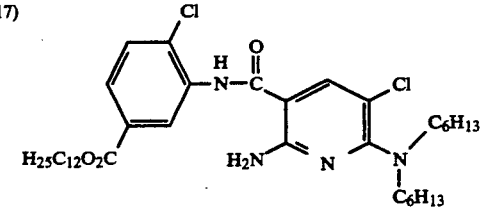
(19)
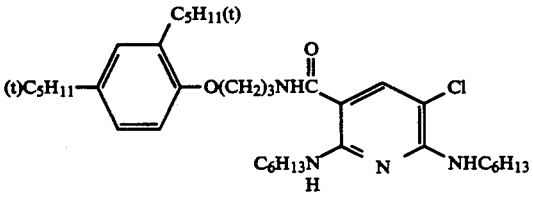
(20)
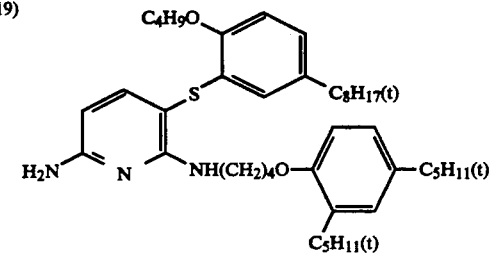

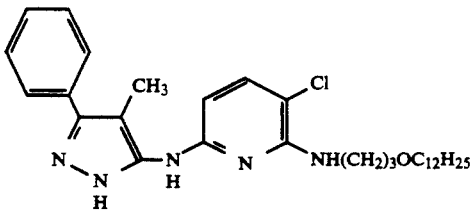

-continued (21)

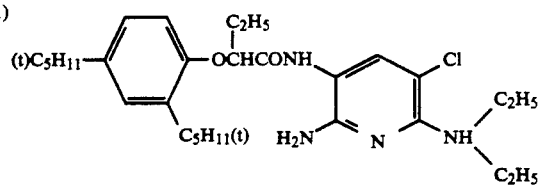

(22)

(23)

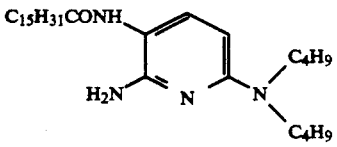

Synthesis Examples of typical couplers of the present invention will be described below.

SYNTHESIS EXAMPLES

Synthesis Example of Coupler (1) and Coupler (4)

5.46 g of 2,6-diaminopyridine and 4.0 g of p-toluenesulfonic acid were dispersed in 40 ml of dodecyloxypropylamine and the mixture was stirred for 12 hours at 170° to 180° C. The temperature was returned to room temperature and purification was carried out by 10 column chromatography, to obtain 7.0 g of coupler (1) in the form of colorless crystals (melting point: 45° to 47° C.) and 6.2 g of coupler (4) in the form of a colorless oil.

Other couplers can be synthesized similarly by using 2,6-diaminopyridine as a starting material. $R^2$ and $R^3$ can be incorporated to compounds by known processes. For Example, NH— group can be incorporated by a nitration or an azo-coupling reaction, carbamoyl group can be incorporated by the Kolbe reaction or by a reaction with phenylisocyanate, and chlorine can be incorporated by a halogenation reaction.

Preferably the coupler of the present invention is dissolved in a high-boiling solvent (if necessary a low-boiling solvent is simultaneously used), the solution is emulsified and dispersed in an aqueous gelatin solution, and the emulsified dispersion is added to a silver halide emulsion. If the coupler is soluble in an aqueous alkaline solution, the coupler may be dissolved together with a developing agent and other additives in the aqueous alkaline solution to be used as so-called coupler-in-developer to form an image.

On the other hand, the coupler can be used together with a developing agent and an alkali (if necessary an organic solvent is added), and it can be oxidized and coupled by using an oxidizing agent (e.g., persulfates, silver nitrate, nitrous acid, or its salts) or the compound of formula (I), wherein n=0 may be condensed by using a p-nitrosoaniline and an alkali or glacial acetic acid, thereby forming a dye, and the obtained dye can be used as a cyan dye for various applications (e.g., as dyes for filters, paints, inks, and for recording or printing of image and information).

In the photographic material according to the present invention, various anti-fading agents (e.g. discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned as typical. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. Nos. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the desired purpose, these compounds can be added to the photosensitive layers by coemulsifying them with the corresponding couplers, with the amount of each compound being generally 5 to 100 wt. % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229) or benzoxazol compounds (e.g., those described in U.S. Pat. No. 3,700,455) can be used. Ultraviolet absorbing couplers (e.g., α-naphthol type cyan dye-forming couplers) and ultraviolet-absorbing polymers can, for example, be used. These ultraviolet-absorbing agents may be mordanted in a particular layer.

In particular, the above-mentioned aryl-substituted benzotriazole compounds are preferable.

As the above-mentioned high-boiling solvent, one having a melting point of 100° C. or below (preferably 80° C. or below) and a boiling point of 140° C. or over (preferably 160° C. or over) and capable of dissolving the coupler can be used, and examples thereof include phosphates (e.g., tricresyl phosphate, trioctyl phosphate, and tricyclohexyl phosphate), organic esters (e.g., dibutyl phthalate, dioctyl phthalate, dicyclohexyl phthalate, dodecyl benzoate, and bis(2-ethylhexyl) sebacate), ethers (including epoxy compounds), amides, and amines, which may be cyclic. Further, high-boiling organic solvents used in the below-mentioned oil-in-water dispersion method can also be used.

The silver halide color photographic materials containing a cyan coupler of the present invention will now be described.

In the silver halide color photographic material of the present invention, at least one layer of the silver halide color photographic material contains a cyan dye-forming coupler represented by formula (I). When the photographic material contains a coupler represented by formula (I), preferably at least one of Z, $R^1$, $R^2$, and $R^3$ of formula (I) has 10 to 50 of carbon atoms.

Although these couplers can be added to a silver halide emulsion layer photosensitive to the visible region or infrared region or to a layer adjacent to that layer, in order to attain the object of the present invention, preferably they are added to a photosensitive silver halide emulsion layer, and more preferably to a red-sensitive silver halide emulsion layer.

The amount of the present cyan dye-forming coupler to be added is $1\times10^{-3}$ to 1 mol, and more preferably $2\times10^{-3}$ to $3\times10^{-1}$ mol, per mol of the silver halide.

The photographic materials of the present invention can be applied to any processing step if the step uses a color developer. For example, they can be applied to processing of color papers, color reversal papers, color positive films, color negative films, color reversal films, color direct positive photographic materials, etc., and, particularly preferably, color papers and color reversal papers.

The silver halide emulsion of the photographic material used in the present invention may have any halogen composition, such as silver bromoiodide, silver bromide, silver chlorobromide, and silver chloride.

When the color photographic material of the present invention is a color negative film or a color reversal photographic material, preferably the silver halide contained in its photographic emulsion layer is silver bromochloroiodide, silver chloroiodide, or silver bromoiodide that contains about 30 mol % or below of silver iodide, and particularly preferably it is silver bromochloroiodide or silver bromoiodide that contains about 2 to 25 mol % of silver iodide.

When the photographic material of the present invention is a color photographic paper, as the silver halide contained in the photographic emulsion layer of the material silver chlorobromide or silver chloride that is substantially free from silver iodide is preferably used. Herein the term "substantially free from silver iodide" means that the silver iodide content is 1 mol % or below, and preferably 0.2 mol % or below.

As to the silver halide composition of these silver chlorobromide emulsions, the ratio of silver bromide/silver chloride can be selected arbitrarily. That is, the ratio is selected from the broad range in accordance with the purpose, but the ratio of silver chloride in a silver chlorobromide is preferably 2% or over. For the purpose of reducing the amount of a replenisher a emulsion of almost pure silver chloride having 98 to 100 mol % of silver chloride content may be used preferably.

In these high-silver-chloride emulsions, the structure is preferably such that the silver bromide localized phase in the layered form or nonlayered form is present in the silver halide grain and/or on the surface of the silver halide grain as mentioned above. The silver bromide content of the composition of the above-mentioned localized phase is preferably at least 10 mol %, and more preferably over 20 mol %. The localized phase may be present in the grain, or on the edges, or corners of the grain surfaces, or on the planes of the grains, and a preferable example is a localized layer epitaxially grown on each corner of the grain.

When the photographic material of the present invention is a direct positive color photographic material, silver chlorobromide or silver chloride is preferably used as the silver halide contained in the photographic emulsion layer.

The silver halide grains of the silver halide emulsion may be regular grains comprising regular crystal such as cubes, octahedrons, or tetradecahedrons, or irregular crystals such as spherical crystals or plate-like crystals, crystals having defects such a twin planes, or composites thereof.

The grain diameter of the silver halide may be fine grains about 0.2 μm or less, or coarse grains wherein the diameter of the projected area is about 10 μm, and a polydisperse emulsion or a monodisperse emulsion can be used.

The silverhalide emulsion to be used in the present invention may be either the so-called surface-latent image type emulsion wherein a latent image is formed mainly on the grain surface or the so-called internal latent image type emulsion wherein a latent image is formed mainly grain inside.

The silver halide photographic emulsion that can be used in this invention may be prepared suitably by known means, for example by the methods described in "I. Emulsion Preparation and Types" in *Research Disclosure* (RD), No. 17643 (December 1978), pp. 22–23, and in RD, No. 18716 (November 1979) p. 648; the methods described in P. Glafkides "Chemie et Phisique Photographique", Paul Montel (1967), in G. F. Duffin "Photographic Emulsion Chemistry", Focal Press (1966), and in V. L. Zelikman et al. "Making and Coating of Photographic Emulsion", Forcal Press (1964).

A monodisperse emulsion, such as described in U.S. Pat. Nos. 3,574,628 and 3,655,394, and in British Patent No 1,413,748, is also preferable.

Tabular grains having an aspect ratio of 5 or greater can be used in the emulsion of the present invention. Tabular grains can be easily prepared by the methods described in Gutoff "Photographic Science and Engineering", Vol. 14, pp. 248–257 (1970), U.S. Pat. Nos. 4,434,226, 4,414,310, 4,433,048, and 4,439,520, and British Patent No. 2,112,157.

The crystal structure of the emulsion grains may be uniform, the outer halogen composition of the crystal structure may be different from the inner halogen composition, or the crystal structure may be layered. Silver halides whose compositions are different may be joined by the epitaxial joint, or a silver halide may be joined, for example, to a compound other than silver halides, such as silver rhodanide, lead oxide, etc.

Further, the silver halide may be a mixture of grains having various crystal shapes.

The silver halide emulsion for use in the present invention may be physically ripened, chemically ripened, and spectrally sensitized.

Into the silver halide emulsion used in the present invention can be introduced various polyvalent metal ion impurities in the process of the formation or physical ripening of the emulsion grains. Examples of the compound to be used include a salt of cadmium, zinc, lead, copper, thulium, etc., and a salt or complex salt of iron, ruthenium, rhodium, palladium, osmium, iridium, and platinum that are elements of Group VIII.

Additives that will be used in physical ripening, chemical ripening, and spectral sensitization of the silver halide emulsion for use in the present invention are described in *Research Disclosure* No. 17643 and ibid. No. 18716, and the involved sections are listed in the Table below. Known photographic additives that can be used in the present invention are also described in the above-mentioned two *Research Disclosures*, and the involved sections are listed in the same Table below.

| | Additive | RD 17643 | RD 18716 |
|---|---|---|---|
| 1 | Chemical sensitizer | p.23 | p.648 (right column) |
| 2 | Sensitivity-enhancing agents | — | ditto |
| 3 | Spectral sensitizers and Superstabilizers | pp.23–24 | pp.648 (right column -649 (right column) |
| 4 | Brightening agents | p.24 | — |
| 5 | Antifogging agents and Stabilizers | pp.24–25 | p.649 (right column) |
| 6 | Light absorbers, Filter dyes, and UV Absorbers | pp.25–26 | pp.649 (right column) -650 (left column) |
| 7 | Stain-preventing agents | p.25 (right column) | p.650 (left to right column) |
| 8 | Image dye stabilizers | p.25 | — |
| 9 | Hardeners | p.26 | p.651 (left column) |
| 10 | Binders | p.26 | ditto |
| 11 | Plasticizers and Lubricants | p.27 | p.650 (right column) |
| 12 | Coating aids and Surface-active agents | pp.26–27 | ditto |
| 13 | Antistatic agents | p.27 | ditto |

Further, in order to prevent the lowering of photographic performances due to formaldehyde gas, a compound described in, for example, U.S. Pat. Nos. 4,411,987 and 4,435,503 that is able to react with formaldehyde to immobilize it can be added to the photographic material.

Various color couplers can be used in this invention, and typical examples are described in the patents in the above-mentioned *Research Disclosure* No. 17643, VII-C to G.

As yellow couplers, those described, for example, in U.S. Pat. Nos. 3,933,501, 4,022,620, 4,326,024, 4,401,752, and 4,428,961, JP-B ("JP-B" means examined Japanese patent publication) No. 10739/1983, British Patent Nos. 1,425,020 and 1,476,760, U.S. Pat. Nos. 3,973,968, 4,314,023, and 4,511,649, and European Patent No. 249,473A are preferable.

From the standpoint of color reproduction, preferably the coupler of the present invention is used in combination with a yellow coupler wherein the wavelength of maximum absorption by the color-formed dye is on the short wavelength side and the absorption at the long wavelength over 500 nm decreases sharply. Such couplers are described, for example, in JP-A Nos. 123047/1988 and 173499/1989.

As magenta couplers, the 5-pyrazolone type and pyrazoloazole type are preferable, and those described in U.S. Pat. Nos. 4,310,619 and 4,315,897, European Patent No. 73,636, U.S. Pat. Nos. 3,061,432 and 3,725,067, *Research Disclosure* No. 24220 (June 1984), JP-A No. 33552/1985, *Research Disclosure* No. 24230 (June 1984), JP-A Nos. 43659/1985, 72238/1986, 35730/1985, 118034/1980, and 185951/1985, U.S. Pat. Nos. 4,500,630, 4,540,654, and 4,556,630, and International Patent Publication No. WO 88/04795 are particularly preferable.

As cyan couplers, the phenol-type couplers and naphthol-type couplers can be used in combination with the coupler of the present invention, and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, European Patent Nos. 121,365A and 249,453A, U.S. Pat. Nos. 3,446,622, 4,333,999, 4,775,616, 4,451,559, 4,427,767, 4,690,889, 4,254,212, and 4,296,199, and JP-A No. 42658/1986 are more preferable.

As a colored coupler to rectify the unnecessary absorption of color-forming dyes, those couplers described in paragraph VII-G of *Research Disclosure* No. 17643, U.S. Pat. No. 4,163,670, JP-B No. 39413/1982, U.S. Pat. Nos. 4,004,929, and 4,138,258, British Patent No. 1,146,368 are preferable. Further, it is preferable to use couplers to rectify the unnecessary absorption of color-forming dye by fluorescent dye released upon the coupling described in U.S. Pat. No. 4,774,181 and couplers having a dye precursor, as a group capable of being released, that can react with the developing agent to form a dye described in U.S. Pat. No. 4,777,120.

As a coupler which forms a dye having moderate diffusibility, those described in U.S. Pat. No. 4,366,237, British Patent No. 2,125,570, European Patent No. 96,570, West German Patent Application (OLS) No. 3,234,533 are preferable.

Typical examples of a polymerized dye-forming coupler are described in U.S. Pat. Nos. 3,451,820, 4,080,211, 4,367,282, 4,409,320, and 4,576,910, and British Patent No. 2,102,173.

A coupler that releases a photographically useful residue accompanied with the coupling reaction can be used favorably in this invention. As a DIR coupler that releases a development retarder, those described in patents cited in paragraph VII-F of the above-mentioned *Research Disclosure* No. 17643, JP-A Nos. 151944/1982, 154234/1982, 184248/1985, 37346/1988, and 37350/1988, and U.S. Pat. Nos. 4,286,962 and 4,782,012 are preferable.

As a coupler which releases, imagewisely, a nucleating agent or a development accelerator upon developing, those described in British Patent Nos. 2,097,140 and 2,131,188, and JP-A Nos. 157638/1984 and 170840/1984 are preferable.

Other couplers that can be incorporated in the photographic material of this invention include competitive couplers described in U.S. Pat. No. 4,130,427, multi-equivalent couplers described in U.S. Pat. Nos. 4,283,472, 4,338,393, and 4,310,618, couplers which release a DIR redox compound, couplers which release a DIR coupler, and redox compounds which release a DIR coupler or a DIR redox described in JP-A Nos. 185950/1985 and 24252/1987, couplers which release a dye to regain a color after releasing described in European Patent Nos. 173,302A and 313,308A, couplers which release a bleaching-accelerator described in RD. Nos. 11449 and 24241, and JP-A No. 201247/1986, couplers which release a ligand described in U.S. Pat. No. 4,553,477, couplers which release a leuco dye described in JP-A No. 5747/1988, and couplers which release a fluorescent dye described in U.S. Pat. No. 4,774,181.

The couplers to be used in this invention can be incorporated to photographic materials by various known dispersing processes.

Examples of a high-boiling organic solvent for use in the oil-in-water dispersing process are described, for example, in U.S. Pat. No. 2,332,027.

Specific examples of high-boiling organic solvents having a boiling point of 175° C. or over at atmospheric pressure that are used in the oil-in-water dispersing process include phthalate ester (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl) isophthalate, and bis(1,1-diethylpropyl)phthalate), phosphate or phosphonate ester (e.g, triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphonate), benzoate ester (e.g., 2-ethylhexyl benzoate, dodecyl benzoate, and 2-ethylhexyl-p-hydroxy benzoate), amide (e.g., N,N-diethyldodecaneamide, N,N-diethyleaurylamide, and N-tetradecylpyrrolidone), alcohol or phenol (e.g., isostearyl alcohol and 2,4-di-t-amylphenol), ester of aliphatic carbonic acid (e.g., bis(2-ethylhexyl) sebacate, dioctyl azelate, glycerol tributylate, isostearyl lactate, and trioctyl citrate), aniline dirivative (e.g., N,N-dibutyl-2-butoxy-5-t-octyl aniline), and hydrocarbon (e.g., paraffin, dodecylbenzene and diisopropylnaphthalene). Organic solvents having a boiling point of 30° C. or over, preferably 30° to 160° C., for example, such as ethyl acetate, butyl acetate, ethyl propionate, methylethyl ketone, 2-ethoxyethyl acetate, and dimethylformaldehyde may be used.

The steps and effects of the latex dispersion method and examples of latex for impregnation are described, for example, in U.S. Pat. No. 4,199,363, and West German Patent Application (OLS) Nos. 2,541,274 and 2,541,230.

These couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

In the color photographic material of this invention, it is preferable to add various preservatives or mildew proofing agents, such as 1,2-benzisothiazoline-3-one, n-butyl-p-hydroxy benzoate, phenol, 4-chloro-3,5-dimethyl phenol, 2-phenoxyethaol, and 2-(4-thiazolyl)-benzimidazole, as described in JP-A Nos. 257747/1988, 272248/1987, and 80941/1989.

When the color photographic material of the present invention is a direct positive color photographic material, a nucleating agent and a nucleating accelerator for making the effect of the nucleating agent higher, such as hydrazine-type compound or tertiary heterocyclic compound described, for example, in *Research Disclosure* No. 22534 (January, 1983), can be used.

When the color photographic material of the present invention is a negative photographic material for photographing, preferably the total layer thickness of all the hydrophilic colloid layers on the side having emulsion layers is 28 μm or below, more preferably 23 μm or below, and further more preferably 20 μm or below. Preferably the film swelling speed $T_{\frac{1}{2}}$ is 30 sec or below, more preferably 20 sec or below. The term "layer thickness" means layer thickness measured after moisture conditioning at 25° C. and a relative humidity of 55% for 2 days, and the film swelling speed $T_{\frac{1}{2}}$ can be measured in a manner known in the art. For example, the film swelling speed $T_{\frac{1}{2}}$ can be measured by using a swellometer (swell-measuring meter) of the type described by A. Green in *Photographic Science and Engineering*, Vol. 19, No. 2, pages 124 to 129, and $T_{\frac{1}{2}}$ is defined as the time required to reach a film thickness of ½ of the saturated film thickness that is 90% of the maximum swelled film thickness that will be reached when the film is treated with a color developer at 30° C. for 3 min 15 sec.

The film swelling speed $T_{\frac{1}{2}}$ can be adjusted by adding a hardening agent to the gelatin, which is a binder or by changing the time conditions after the coating. Preferably the ratio of swelling is 150 to 400%. The ratio of swelling is calculated from the maximum swelled film thickness obtained under the above conditions according to the formula:

$$\text{Ratio of Swelling} = \frac{\text{Maximum swelled film thickness} - \text{Film thickness}}{\text{Film thickness}} \times 100$$

Suitable bases to be used in the present invention are described, for example, in the above-mentioned *Research Disclosure* No. 17643, page 28 and ibid. No. 18716, from page 647, right column to page 648, left column. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The opposite side to metal surface side of the base according to the present invention is preferably provided with an antistatic layer. The details of such base are described, for example, in JP-A Nos. 210346/1986, 24247/1988, 24251/1988 and 24255/1988.

These bases can be suitably selected according to the purpose of use.

The color photographic material according to the present invention can be subjected to a development processing using the usual method described, for example, in *Research Disclosure,* No. 17643, supra, pages 28 to 29 and ibid. No. 18716, left column to right column of page 615. For example, color developing process, desilvering process, and water washing process may be carried out. In the desilvering process, a bleach-fixing process using a bleach-fixing solution may be employed instead of a bleaching process using a bleaching solution and a fixing process using a fixing solution, or a combination of arbitrary order of bleaching process, fixing process, and bleach-fixing process may be employed. A stabilizing process may be carried out instead of a water-washing process an after water-washing process. Mono-bath processing wherein color development, bleaching, and fixing are carried out in one bath using a mono-bath developing-bleaching-fixing solution may be employed. In combination with these processing processes, prehardening layer process, its neutralizing process, stop fixing processing, post-layer hardening processing, compensating process and intensification process can be carried out. An intermediate water-washing process between these processes may be provided arbitrarily. In these processes, the so-called activater-processing may be carried out instead of color developing process.

It is preferable that the present color photographic material is color-developed, bleach-fixed, and washed (or stabilized). The bleach and the fixing may not be effected in the single bath described above, but may be effected separately.

The color developer used in the present invention contains an aromatic primary amine color-developing agent. As the color-developing agent conventional ones can be used. Preferred examples of aromatic primary amine color-developing agents are p-phenylenediamine derivatives. Representative examples are given below, but they are not meant to limit the present invention:

D-1: N,N-diethyl-p-phenylenediamine
D-2: 2-amino-5-diethylaminotoluene
D-3: 2-amino-5-(N-ethyl-N-laurylamino)toluene
D-4: 4-[N-ethyl-N-(β-hydroxyethyl)amino]aniline
D-5: 2-methyl-4-[N-ethyl-N-(β-hydroxyethyl)amino]-aniline
D-6: 4-amino-3-methyl-N-ethyl-N-[β-(methanesulfonamido)ethyl]-aniline
D-7: N-(2-amino-5-diethylaminophenylethyl)methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N-β-ethoxyethylaniline
D-11: 4-amino-3-methyl-N-ethyl-N-β-butoxyethylaniline Of the above-mentioned p-phenylenediamine derivatives, 4-amino-3-methyl-N-ethyl-N-[β-(methanesulfonamido)ethyl]-aniline (exemplified compound D-6) is particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 10 g, per liter of developer.

In practicing the present invention, it is preferable to use a developer substantially free from benzyl alcohol. Herein the term "substantially free from" means that the concentration of benzyl alcohol is preferably 2 ml/l or below, and more preferably 0.5 ml/l or below, and most preferably benzyl alcohol is not contained at all.

It is more preferable that the developer used in the present invention is substantially free from sulfite ions. Sulfite ions serve as a preservative of developing agents, and at the same time have an action for dissolving silver halides, and they react with the oxidized product of the developing agent, thereby exerting an action to lower the dye-forming efficiency. It is presumed that such actions are one of causes for an increase in the fluctuation of the photographic characteristics. Herein the term "substantially free from" sulfite ions means that preferably the concentration of sulfite ions is $3.0\times10^{-3}$ mol/l or below, and most preferably sulfite ions are not contained at all. However, in the present invention, a quite small amount of sulfite ions used for the prevention of oxidation of the processing kit in which the developing agent is condensed is not considered.

Preferably, the color developer used in the present invention is substantially free from sulfite ions, and more preferably, in addition thereto it is substantially free from hydroxylamine. This is because hydroxylamine serves as a preservative of the developer, and at the same time has itself an activity for developing silver, and it is considered that the fluctuation of the concentration of hydroxylamine influences greatly the photographic characteristics. Herein the term "substantially free from hydroxylamine" means that preferably the concentration of hydroxylamine is $5.0\times10^{-3}$ mol/l or below, and most preferably hydroxylamine is not contained at all.

It is preferable that the developer used in the present invention contains an organic preservative instead of hydroxylamine or sulfite ions, in that process color-contamination and fluctuation of the photographic quality in continuous processing can be suppressed.

Herein the term "organic preservative" refers to organic compounds that generally, when added to the processing solution for the color photographic material, reduce the speed of deterioration of the aromatic primary amine color-developing agent. That is, organic preservatives include organic compounds having a function to prevent the color-developing agent from being oxidized, for example, with air, and in particular, hydroxylamine derivatives (excluding hydroxylamine, hereinafter the same being applied), hydroxamic acids, hydrazines, hydrazides, phenols, α-hydroxyketones, α-aminoketones, saccharides, monoamines, diamines, polyamines, quaternary amines, nitroxyradicals, alcohols, oximes, diamide compounds, and condensed cyclic amines are effective organic preservatives. These are disclosed, for example, in JP-A Nos. 4235/1988, 30845/1988, 21647/1988, 44655/1988, 5355/1988, 43140/1988, 56654/1988, 58346/1988, 43138/1988, 146041/1988, 170642/1988, 44657/1988, and 44656/1988, U.S. Pat. Nos. 3,615,503 and 2,494,903, JP-A No. 143020/1977, and JP-B 30496/1973.

As the other preservative, various metals described, for example, in JP-A Nos. 44148/1982 and 53749/1982, salicylic acids described, for example, in JP-A No. 180588/1984, alkanolamines described, for example, in JP-A No. 3532/1979, polyethyleneimines described, for example, in JP-A No. 94349/1981, aromatic polyhydroxyl compounds described, for example, in U.S. Pat. No. 3,746,544 may be included, if needed. It is particularly preferable the addition of alkanolamines such as triethanolamine, dialkylhydroxylamines such as diethylhydroxylamine, hydrazine derivatives, or aromatic polyhydroxyl compounds.

Of the above organic preservatives, hydroxylamine derivatives and hydrazine derivatives (i.e., hydrazines and hydrazides) are preferable and the details are described, for example, in Japanese Patent Application Nos. 255270/1987, 9713/1988, 9714/1988, and 11300/1988.

The use of amines in combination with the above-mentioned hydroxylamine derivatives or hydrazine derivatives is preferable in view of stability improvement of the color developer resulting in its stability improvement during the continuous processing.

As the example of the above-mentioned amines cyclic amines described, for example, in JP-A No. 239447/1988, amines described, for example, in JP-A No. 128340/1988, and amines described, for example, in Japanese Patent Application Nos. 9713/1988 and 11300/1988.

In the present invention, it is preferable that the color developer contains chloride ions in an amount of $3.5\times10^{-2}$ to $1.5\times10^{-1}$ mol/l, more preferably $4\times10^{-2}$ to $1\times10^{-1}$ mol/l. If the concentration of ions exceeds $1.5\times10^{-1}$ mole/l, it is not preferable that the development is made disadvantageously slow, not leading to attainment of the objects of the present invention such as rapid processing and high density. On the other hand, if the concentration of chloride ions is less than $3.5\times10^{-2}$ mol/l, fogging is not prevented.

In the present invention, the color developer contains bromide ions preferably in an amount of $3.0\times10^{-5}$ to $1.0\times10^{-3}$ mol/l. More preferably bromide ions are contained in an amount $5.0\times10^{-5}$ to $5.0\times10^{-4}$ mol/l, most preferably $1.0\times10^{-4}$ to $3.0\times10^{-4}$ mol/l. If the concentration of bromide ions is more than $1.0\times10^{-3}$ mol/l, the development is made slow, the maximum density and the sensitivity are made low, and if the concentration of bromide ions is less than $3.0\times10^{-5}$ mol/l, fogging is not prevented sufficiently.

Herein, chloride ions and bromide ions may be added directly to the developer, or they made be allowed to dissolve out form the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied from a brightening agent.

As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

Preferably the color developer used int he present invention has a pH of 9 to 12, and more preferably 9 to 11.0, and it can contain other known developer components.

In order to maintain the above pH, it is preferable to use various buffers. As buffers ,use can be made, for example, of phosphates, carbonates, borates, tetraborates, hydroxybenzoates, glycyl salts, N,N-dimethylglycinates, leucinates, norleucinates, guanine salts, 3,4-dihydroxyphenylalanine salts, alanine salts, aminolbutyrates, 2-amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function int he high pH range of a pH of 9.0 or higher, they do not adversely affect the photographic function (for example, to cause fogging), and they are inexpensive. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of buffer to be added to the color developer is preferably 0.1 mol/l or more, and particularly preferably 0.1 to 0.4 mol/l.

In addition to the color developer can be added various chelating agents to prevent calcium or magnesium from precipitating or to improve the stability of the color developer. As the example of chelating agents can be mentioned nitrilotriacetic acid, diethylenediaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, glycol ether diaminetetraacetic acid, ethylenediamine-ortho-hyroxyphenyltetraacetic acid, 2-phosphonobutane-1,2,4-tricarboxylic acid, 1-hydroxyethylidene-1,1-diphosphonic acid, and N,N,-bis(2-hydroxybenzyl)ethylenediamine-N,N'-diacetic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenyleediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-triazolylbenzimidazole, 2-thiazolylmethyl-benzimidazole, indazole, hydroxyazaindolizine, and adenine.

It is preferable that the color developer used in the present invention contains a brightening agent. As a brightening agent, 4,4'-diamino-2,2'-disulfostilbene compounds are preferable. The amount of brightening agent to be added is 0 to 5 g/l, and preferably 0.1 to 4 g/l.

If necessary, various surface-active agents may be added, such as alkyl sulfonates, aryl sulfonates, aliphatic acids, and aromatic carboxylic acids.

The processing temperature of the color developer of the invention is 20° to 50° C., and preferably 30° to 40° C. The processing time is 20 sec to 5 min, and preferably 30 sec to 2 min. Although it is preferable that the replenishing amount is as small as possible, it is suitable that the replenishing amount is 20 to 600 ml, preferably 50 to 300 ml, more preferably 60 to 200 ml, and most preferably 60 to 150 ml, per square meter of the photographic material.

The desilvering step in the present invention will now be described. Generally the desilvering step may comprise, for example, any of the following steps: a bleaching step—a fixing step; a fixing step—a bleach-fixing step; a bleaching step—a bleach-fixing step; and a bleach-fixing step.

Next, the bleaching solution, the bleach-fixing solution, and the fixing solution that are used in the present invention will be described.

As the bleaching agent used in the bleaching solution or the bleach-fixing solution used in present invention, use is made of any bleaching agents, but particularly it is preferable to use organic complex salts of iron(III) (e.g., complex salts of aminopolycarboxylic acids, such as ethylenediaminetetraacetic acid, and diethylenetriaminepentaacetic acid, aminopolyphosphonic acids, phosphonocarboxylic acids, and organic phosphonic acids); organic acids, such as citric acid, tartaric acid, and malic acid; persulfates; and hydrogen peroxide.

Of these, organic complex salts of iron(III) are particularly preferable in view of the rapid processing and the prevention of environmental pollution. Aminopolycarboxylic acids, aminopolyphosphonic acids, or organic phosphonic acids, and their salts useful to form organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid. These compounds may be in the form of any salts of sodium, potassium, lithium, or ammonium. Of these compounds, iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferable, because they are high in bleaching power. These ferric ion, complex salts may be used in the form of a complex salt, or they may be formed in solution by using a ferric salt such as ferric sulfate, ferric chloride, ferric nitrate, ammonium ferric sulfate, and ferric phosphate, and a chelating agent such as aminopolycarboxylic acids, aminopolyphosphonic acids, and phosphonocarboxylic acids. The chelating agent may be used in excess to form the ferric ion complex salt. Of iron complexes, aminopolycarboxylic acid iron complexes are preferable, and the amount thereof to be added is 0.01 to 1.0 mol/l, and more preferably 0.05 to 0.50 mol/l.

In the bleaching solution, the bleach-fix solution, and/or the bath preceding them, various compounds may be used as a bleach accelerating agent. For example, the following compounds are used: compounds having a mercapto group or a disulfido bond, described in U.S. Pat. No. 3,893,858, German Patent No. 1,290,812, JP-A No. 95630/1978, and *Research Disclosure* No. 17129 (July 1978), thiourea compounds described, for example, in JP-B No. 8506/1970, JP-A Nos. 20832/1977 and 32735/1978, and U.S. Pat. No. 3,706,561, or halides such as iodides and bromides, which are preferable because of their excellent bleaching power.

Further, the bleaching solution or the bleach-fixing solution used in the present invention can contain rehalogenizing agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contained, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the bleaching solution can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8- octanedithiol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol. The pH range of the bleach-fixing solution or the fixing solution is preferably 3 to 10, and particularly preferably 5 to 9.

Further, the bleach-fixing solution may additionally contain various brightening agents, anti-foaming agents, surface-active agents, polyvinyl pyrrolidone, and organic solvents, such as methanol.

The bleach-fixing solution or the fixing solution contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.05 mol/l, and more preferably 0.04 to 0.40 mol/l, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelating agents, anti-foaming agents, and mildew-proofing agents may be added.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television* Engineers, Vol. 64, pp. 248 to 253 (May 1955). Generally, the number of stages in a multi-stage countercurrent system is preferably 2 to 6, and particularly preferably 2 to 4.

According to the multi-stage countercurrent system, the amount of washing water can be reduced considerably. For example, the amount can be 0.5 to 1 per square meter of the photographic material, and the effect of the present invention is remarkable. But a problem arises that bacteria can propagate due to the increase in the dwelling time of the water in the tanks, and the suspended matter produced will adhere to the photographic material. To solve such a problem in processing the color photographic material of the present invention, the process for reducing calcium and magnesium described in JP-A No. 131632/1986 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai no Kagaku, Biseibutsu no Genkin, Sakkin, Bobai Gijutsu* (edited by Eiseigijutsu-kai), and *Bokin Bobai-zai Jiten* (edited by Nihon Bokin Bobai-gakkai), can be used.

Further, the washing water can contain surface-active agents as a water draining agent, and chelating agents such as EDTA as a water softener.

After the washing step mentioned above, or without the washing step, the photographic material is processed with a stabilizer. The stabilizer can contain compounds that have an image-stabilizing function, such as aldehyde compounds, for example typically formalin, buffers for adjusting the pH of the stabilizer suitable to the film pH for the stabilization of the dye, and ammonium compounds. Further, in the stabilizer, use can be made of the above-mentioned bactericides and anti-mildew agent for preventing bacteria from propagating in the stabilizer, or for providing the processed photographic material with mildew-proof properties.

Still further, surface-active agents, brightening agents, and hardening agents can also be added. In the processing of the photographic material of the present invention, if the stabilization is carried out directly without a washing step, known methods described, for example, in JP-A Nos. 8543/1982, 14834/1983, and 220345/1985, can be used.

Further, chelating agents, such as 1-hydroxyethylidene-1,1-diphosphonic acid, and ethylenediaminetetramethylenephosphonic acid, and magnesium and bismuth compounds can also be used in preferable modes.

A so-called rinse can also be used as a washing solution or a stabilizing solution, used after the desilverization.

The pH of the washing step or a stabilizing step is preferably 4 to 10, more preferably 5 to 8. The temperature will vary depending, for example, on the application and the characteristics of the photographic material, and it generally will be 15° to 45° C., and preferably 20° to 40° C. Although the time can be arbitrarily set, it is desirable that the time is as short as possible, because the processing time can be reduced. Preferably the time is 15 sec to 1 min and 45 sec, and more preferably 30 sec to 1 min and 30 sec. It is preferable that the replenishing amount is as low as possible in view, for example, of the running cost, the reduction in the discharge, and the handleability.

The preferable replenishing amount per unit area of photographic material is 0.5 to 50 times, more preferably 3 to 40 times the amount of solution carried over from the preceding bath. In other words, it is 1 liter or below, preferably 500 ml or below, per square meter of photographic material. The replenishing may be carried out continuously or intermittently.

Solutions which are use in the washing process and/or stabilizing process can be used further in a preceding process. For example, the overflow of washing water which is reduced by a multi-stage counter current system is introduced to the preceding bleach-fixing bath and a concentrated solution is replenished into the bleach-fixing bath to reduce the waste solution.

Cyan couplers of the present invention are excellent in fastness to light and fastness to heat, and they are excellent in absorption properties of the color-formed dyes (in other words, there is no subsidiary absorption in the blue and green regions, the absorption waveform is sharp, and color reproduction can be improved). Silver halide color photographic materials using a cyan coupler of the present invention have excellent effects in that they are fast in the image dye, and to light, heat, and humidity; they are excellent in color reproduction, high in dye-forming speed and maximum color density in a color developer, and in particular they are high in dye-forming speed and maximum color density even in a color developer from which benzyl alcohol has been removed. By using such silver halide color photographic materials, a method is attained for processing a silver halide photographic material wherein if the silver halide photographic material is processed with a processing solution that has bleaching power weak in oxidation power (e.g., a processing solution having bleaching power and containing EDTA iron(III) Na salt or EDTA iron (III) $NH_4$ salt) or a fatigued processing solution, the density lowers little.

Next, the present invention will be described in detail in accordance with examples, but the invention is not limited to them.

EXAMPLE 1

A multilayer photographic material was prepared by multi-coatings composed of the following layer composition on an under-coated cellulose triacetate base. Coating solutions were prepared as follows:

Preparation of the Emulsion Layer Coating Solution

To a mixture of 1.85 mmol of cyan coupler and 10 ml of ethyl acetate, tricresyl phosphate (Solvent) in an amount of equal weight of the cyan coupler was added and dissolved. The resulting solution was dispersed and emulsified in 38 g of 14% aqueous gelatin solution containing 3 ml of 10% dodecylbenzenesulfonate solution. Separately silver chlorobromide emulsion (silver bromide: 70.0 mol %) was prepared and sulfur sensitized, and then this emulsion and the above-obtained emulsified dispersion were mixed together and dissolved to give the composition shown below, thereby preparing the coating solution.

Composition of Layers

The composition of each layer used in this experiment is shown below (the figures represent coating amount per $m^2$).

| | |
|---|---|
| Supporting Base | |
| Cellulose triacetate base | |
| Silver emulsion layer | |
| Silver chlorobromide emulsion (above-described) | 8.0 mmol |
| Coupler | 1.0 mmol |
| Solvent (the same coating amount as the coupler) | |
| Gelatin | 5.2 g |
| Protective layer | |
| Gelatin | 1.3 g |
| Acryl-modified copolymer of polyvinyl alcohol (modification degree: 17%) | 0.17 g |
| Liquid paraffin | 0.03 g |

The above-obtained photographic material was processed through the processing process shown below after an imagewise of light.

| Processing step | Temperature | Time |
|---|---|---|
| Color-developing | 33° C. | 3 min |
| Bleach-fixing | 33° C. | 2 min |
| Water-washing | 33° C. | 3 min |

The compositions of each processing solution were as follows:

| | |
|---|---|
| Color developer | |
| Water | 700 ml |
| Benzyl alcohol | 15 ml |
| Diethylene glycol | 10 ml |
| Sodium sulfite | 1.7 g |
| Potassium bromide | 0.6 g |
| Sodium hydrogencarbonate | 0.7 g |
| Potassium carbonate | 31.7 g |
| Hydroxylamine sulfate | 3.0 g |
| N-ethyl-N-(β-methanesulfonamidoethyl)-3-methyl-4-aminoaniline sulfate | 4.5 g |
| Fluorescent brightening agent (WHITEX-4, made by Sumitomo Chemical Ind.) | 1.0 g |
| Water to make | 1000 ml |
| pH | 10.25 |
| Bleach-fixing solution | |
| Water | 400 ml |
| Ammonium thiosulfate (70%) | 150 ml |
| Sodium sulfite | 18 g |
| Iron (III) ammonium ethylenediaminetetraacetate dihydrate | 55 g |
| Disodium ethylenediaminetetraacetate | 5 g |
| Water to make | 1000 ml |
| pH | 6.70 |

Photographic properties are shown in Dmin (minimum density) and Dmax (maximum density). Further, after measuring the cyan density of photographic material immediately after processing, the photographic material was allowed to stand for 5 days at 80° C. (10 to 15 relative the cyan density was measured to obtain the image-dye remaining ratio at the density of 1.0 immediately after processing.

Results are shown in Table 1.

TABLE 1

| Photographic Material No. | Cyan Coupler | Photographic Property Dmin | Photographic Property Dmax | Image-dye Remaining Ratio (%) | Remarks |
|---|---|---|---|---|---|
| 101 | R-1 | 0.06 | 2.01 | 60 | Comparative Example |
| 102 | 2 | 0.05 | 2.40 | 75 | This Invention |
| 103 | 3 | 0.06 | 2.41 | 78 | This Invention |
| 104 | 5 | 0.06 | 2.46 | 74 | This Invention |
| 105 | 7 | 0.06 | 2.45 | 75 | This Invention |
| 106 | 8 | 0.06 | 2.19 | 69 | This Invention |
| 107 | 10 | 0.05 | 2.43 | 74 | This Invention |
| 108 | 14 | 0.05 | 2.42 | 78 | This Invention |
| 109 | 15 | 0.06 | 2.45 | 76 | This Invention |

(R-1):

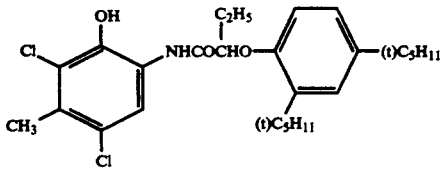

As is apparent from the results in Table 1, it can be understood that the photographic material of the present invention is excellent in color formation and fastness to heat compared with the comparative example.

EXAMPLE 2

A multilayer photographic material was prepared by multi-coatings composed of the following layer composition on a two-side polyethylene laminated paper support. Coating solutions were prepared as follows:

Preparation of the First Layer Coating Solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-1) were added and dissolved. The resulting solution was dispersed and emulsified in 185 ml of 10% aqueous gelatin solution containing 8 ml of sodium dodecylbenzenesulfonate. Separately another emulsion was prepared by adding two kinds of blue-sensitive sensitizing dye, shown below, to a blend of silver chlorobromide emulsions (cubic grains, 3:7 (silver mol ratio) blend of grains having 0.88 μm and 0.7 μm of average grain size, and 0.08 and 0.10 of deviation coefficient of grain size distribution, respectively, each in which 0.2 mol % of silver bromide was located at the surface of grains) in such amounts that each dye corresponds $2.0\times10^{-4}$ mol to the large size emulsion and $2.5\times10^{-4}$ mol to the small size emulsion, per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution. As a gelatin hardener for the respective layers, 1-hydroxy-3,5-dichloro-s-treazine sodium salt was used.

As spectral-sensitizing dyes for the respective layers, the following compounds were used:

Blue-sensitive emulsion layer:

-continued

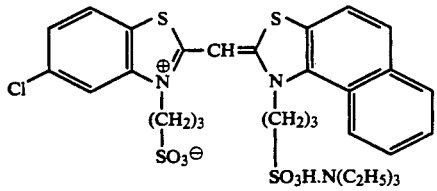

and

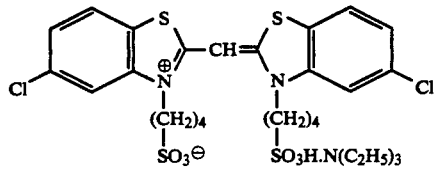

(each $2.0\times10^{-4}$ mol to the large size emulsion and $2.5\times10^{-4}$ mol to the small size emulsion, per mol of silver halide.)

Green-sensitive emulsion layer:

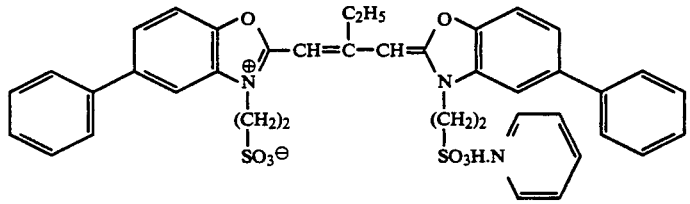

($4.0\times10^{-4}$ mol to the large size emulsion and $5.6\times10^{-4}$ mol to the small size emulsion, per mol of silver halide) and

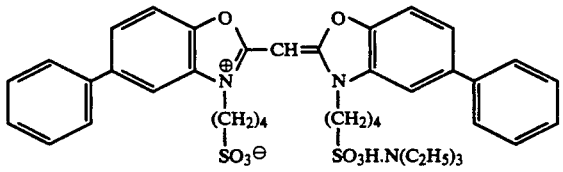

($7.0\times10^{-5}$ mol to the large size emulsion and $1.0\times10^{-5}$ mol to the small size emulsion, per mol of silver halide)

Red-sensitive emulsion layer:

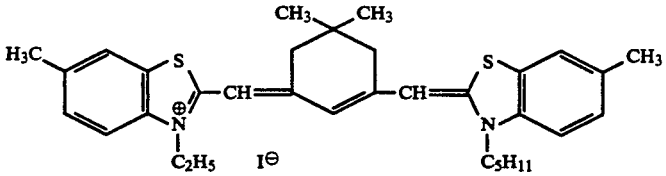

($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

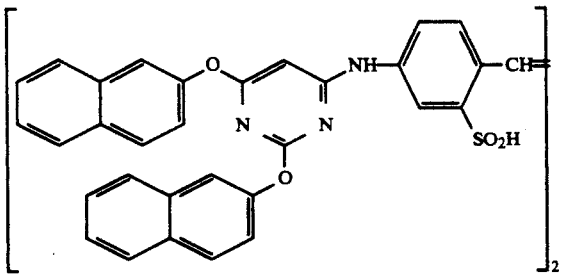

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

The dyes shown below were added to the emulsion layers for prevention of irradiation.

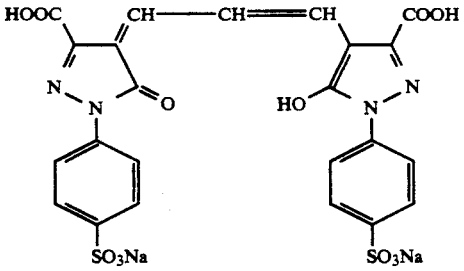

and

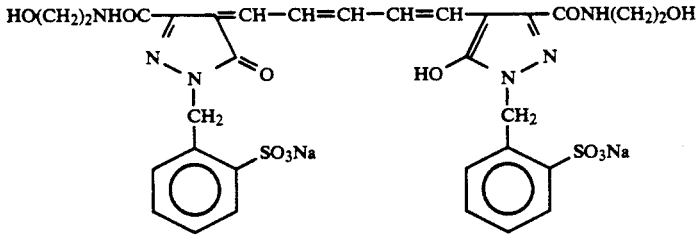

Composition of Layers

The composition of each layer is shown below. The figures represent coating amount (g/m²). The coating amount of each silver halide emulsion is given in terms of silver.

Supporting Base

Paper laminated on both sides with polyethylene (a white pigment, $TiO_2$, and bluish dye, ultramarine, were included in the first layer side of the polyethylene-laminated film)

| | |
|---|---|
| First Layer (Blue-sensitive emulsion layer): | |
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |
| Second Layer (Color-mix preventing layer): | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains, 1:3 (Ag mol ratio) blend of grains having 0.55 μm and 0.39 μm of average grain size, and 0.10 and 0.08 of deviation coefficient of grain size distribution, respectively, each in which 0.8 mol % of AgBr was located at the surface of grains) | 0.12 |
| Gelatin | 1.24 |
| Magenta coupler (ExM) | 0.20 |
| Image-dye stabilizer (Cpd-2) | 0.03 |
| Image-dye stabilizer (Cpd-3) | 0.15 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chlorobromide emulsions (cubic grains, 1:4 (Ag mol ratio) blend of grains having 0.58 μm and 0.45 μm of average grain size, and 0.09 and 0.11 of deviation coefficient of grain size distribution, respectively, each in which 0.6 mol % of AgBr was located at the surface of grains) | 0.23 |
| Gelatin | 1.34 |
| Cyan coupler (cyan coupler) | 0.63 mmol |
| Image-dye stabilizer (Cpd-6) | 0.17 |
| Image-dye stabilizer (Cpd-7) | 0.40 |
| Image-dye stabilizer (Cpd-8) | 0.04 |
| Solvent (Solv-6) | 0.15 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds are as follows:

(ExY) Yellow coupler
Mixture (1:1 in molar ratio) of
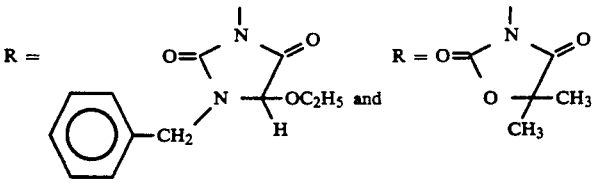
of the following formula
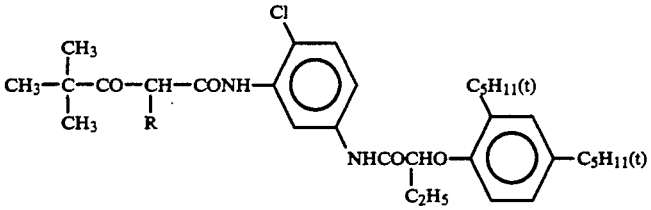
(ExM) Magenta coupler
Mixture (1:1 in molar ratio) of
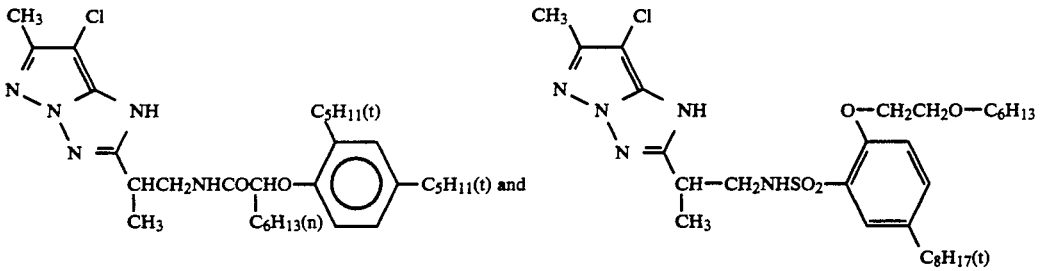
(Cpd-1) Image-dye stabilizer
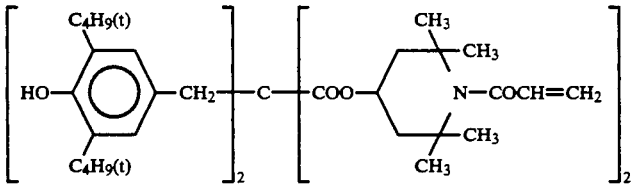
(Cpd-2) Image-dye stabilizer
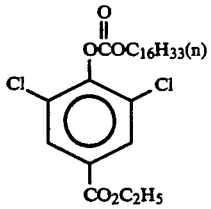
(Cpd-3) Image-dye stabilizer
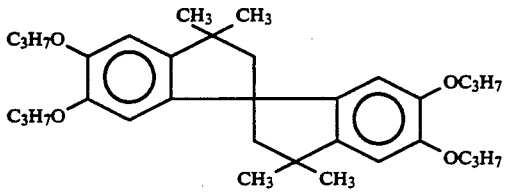
(Cpd-4) Image-dye stabilizer -continued
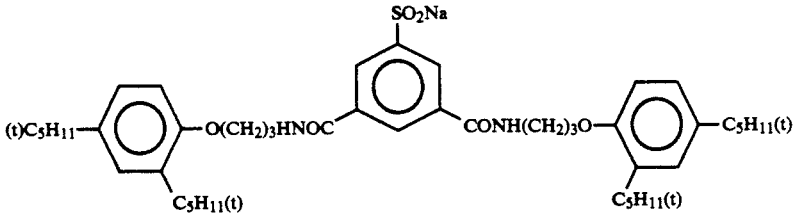
(Cpd-5) Color-mix inhibitor
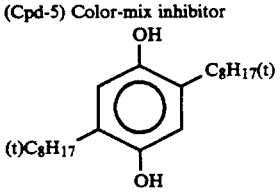
(Cpd-6) Image-dye stabilizer
Mixture (2:4:4 in weight ratio) of
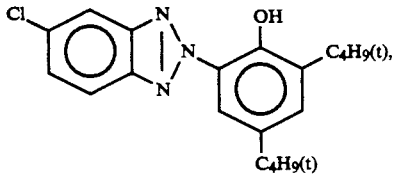
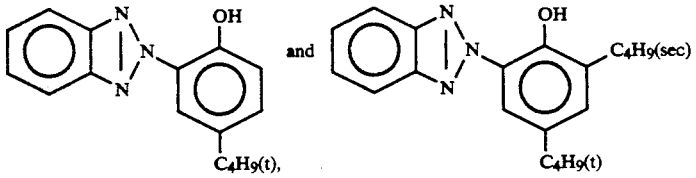
(Cpd-7) Image-dye stabilizer
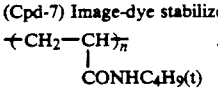
Average molecular weight: 60,000
(Cpd-8) Image-dye stabilizer
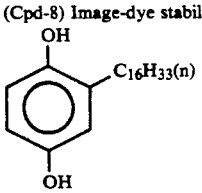
(Cpd-9) Image-dye stabilizer
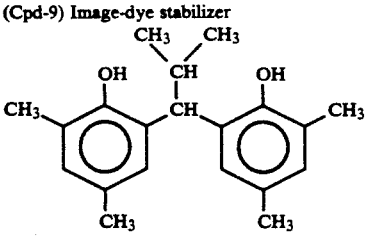
(UV-1) Ultraviolet ray absorber
Mixture (4:2:4 in weight ratio) of
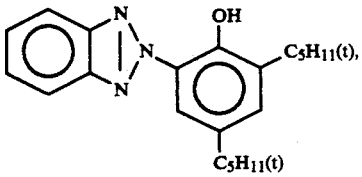

-continued

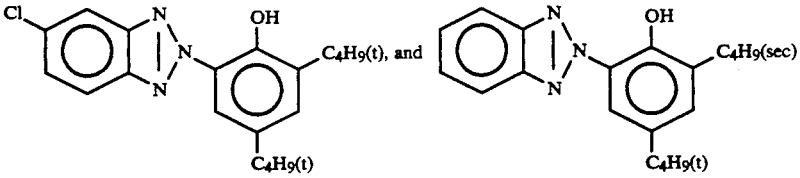

(Solv-1) Solvent

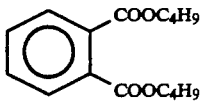

(Solv-2) Solvent
Mixture (2:1 in volume ratio) of

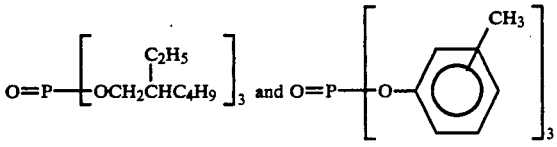

(Solv-4) Solvent

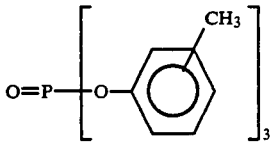

(Solv-5) Solvent

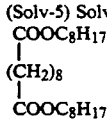

(Solv-6) Solvent

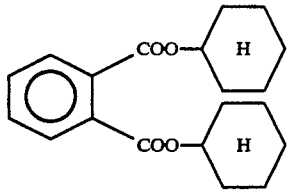

First, each sample was subjected to an exposure to light image-wisely. After exposure to light, each sample was subjected to a continuous processing (running test) according to the processing process shown below by using a paper processor, until the replenishing amount reached twice the tank volume of color developer.

| Processing step | Temperature | Time | Replenisher | Tank Volume |
|---|---|---|---|---|
| Color developing | 35° C. | 45 sec. | 161 ml | 17 l |
| Bleach-fixing | 30–35° C. | 45 sec. | 215 ml | 17 l |
| Rinsing (1) | 30–35° C. | 20 sec. | — | 10 l |
| Rinsing (2) | 30–35° C. | 20 sec. | — | 10 l |
| Rinsing (3) | 30–35° C. | 20 sec. | 350 ml | 10 l |
| Drying | 70–80° C. | 60 sec. | | |

Note:
*Replenisher amount per $m^2$ of photographic material.
Rinsing steps were carried out in a 3 tank countercurrent mode from rising tank (3) toward rising tank (1).

The composition of each processing solution is as follows, respectively:

| | Tank Solution | Replenisher |
|---|---|---|
| Color-developer | | |
| Water | 800 ml | 800 ml |
| Ethylenediamine-N,N,N',N'-tetramethylene phosphonic acid | 1.5 g | 2.0 g |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-Bis(carbosymethyl)hydrazine | 5.5 g | 7.0 g |
| Fluorescent whitening agent (WHITEX-4B, made by Sumitomo chemical Ind.) | 1.0 g | 2.0 g |
| Water to make | 1000 ml | 1000 ml |
| pH | 10.05 | 10.55 |
| Bleach-fixing solution (Both tank solution and replenisher) | | |
| Water | 400 ml | |
| Ammonium thiosulfate (70%) | 100 ml | |
| Sodium sulfite | 17 g | |
| Iron (III) ammonium ethylenediaminetetraacetate | 55 g | |
| Disodium ethylenediaminetetraacetate | 5 g | |

-continued

| | Tank Solution | Replenisher |
|---|---|---|
| Ammonium bromide | 40 g | |
| Water to make | 1000 ml | |
| pH | 6.0 | |
| Rinsing solution | | |
| (Both tank solution and replenisher) | | |
| Ion-exchange water calcium and magnesium each are 3 ppm or below) | | |

The processed photographic materials were processed in a manner similar to Example 1 and the photographic quality and the image dye residue ratio were measured. The photographic materials were also processed in the same way as above, except that the concentration of the iron(II) ethylenediaminetetraacetate in the bleach-fix solution might be 15% for the iron(III) ethylenediaminetetraacetate.

After the processing the maximum density of cyan was measured, and then after the photographic material was processed with CN-16N2, manufactured by Fuji Photo Film Co., Ltd., for 3 min at 35° C., the maximum density was measured again.

The increase in the density was indicated as the color formation ratio (=density immediately after processing/density after processing with CN-16, N2).

The color-forming property, the image dye residue ratio, and the color formation ratio are shown in Table 2.

TABLE 2

| Photographic Material No. | Cyan Coupler | Photographic Property Dmin | Photographic Property Dmax | Image-dye Remaining Ratio (%) | Color Forming Ratio (%) | Remarks |
|---|---|---|---|---|---|---|
| 201 | R-1 | 0.11 | 2.06 | 78 | 80 | Comparative Example |
| 202 | 3 | 0.11 | 2.25 | 90 | 90 | This Invention |
| 203 | 7 | 0.12 | 2.20 | 90 | 90 | This Invention |
| 204 | 8 | 0.12 | 2.07 | 86 | 86 | This Invention |
| 205 | 10 | 0.11 | 2.21 | 89 | 90 | This Invention |
| 206 | 15 | 0.11 | 2.20 | 90 | 90 | This Invention |

As is apparent from Table 2, it can be understood that, in comparison with the comparative examples, the photographic materials of the present invention are excellent in color-forming property and fastness to heat. It can also be understood that when photographic materials of the present invention are used, leuconization of the cyan dye in a bleach-fix solution corresponding to a fatigued solution can be suppressed and stable images can be obtained.

EXAMPLE 3

15.0 g of coupler (I) of the present invention was weighed, then 15.0 g of tricresyl phosphate, a high-boiling organic solvent, was added, 15 ml of ethyl acetate was added to dissolve it, and the solution was emulsified dispersed in 200 g of a 10 wt. % aqueous gelatin solution containing 1.5 g of sodium dodecylbenzenesulfonate.

All of the emulsified dispersion was added to 310 g of a silver bromoiodide emulsion (70.0 g of silver per kg of the emulsion; silver bromide content=10 mol %), a triacetate film base having an undercoat was coated with the resulting mixture so that the coated amount of silver might be 2.15 g/m$^2$, and a gelatin layer as a protective layer was put on the coating layer so that the thickness of the dried coating might be 1.0 μm. As a gelatin hardener 1,2-bis(vinylsulfonylacetamido)ethane was used. When this was processed in the processing steps given below, an effect similar to that obtained in Example 1 was obtained. Similar effects were obtained by using (3), (7), (10), and (15) as cyan couplers.

Color photographic materials exposed to light as described above were subjected to a processing in the following process:

| Process | Processing process: Processing time | Processing temperature |
|---|---|---|
| Color developing | 3 min 15 sec | 38° C. |
| Bleaching | 1 min 00 sec | 38° C. |
| Bleach-fixing | 3 min 15 sec | 38° C. |
| Washing (1) | 40 sec | 35° C. |
| Washing (2) | 1 min 00 sec | 35° C. |
| Stabilizing | 40 sec | 38° C. |
| Drying | 1 min 15 sec | 55° C. |

Composition of each processing solution is described below.

| | (gram) |
|---|---|
| Color developer | |
| Diethylenetriaminetetraacetic acid | 1.0 |
| 1-Hydroxyethylidene-1,1-diphosphnic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-β-hydroxyethylamino]-2-methylaniline sulfate | 4.5 |
| Water to make | 1.0 l |
| pH | 10.05 |
| Bleaching solution | |
| Fe(III)ammonium ethylenediaminetetraacetate dihydsate | 120.0 |
| Disodium ethylenediaminetetraacetate | 10.0 |
| Ammonium bromide | 100.0 |
| Ammonium nitrate | 10.0 |
| Bleaching acceralator | 0.005 mol |

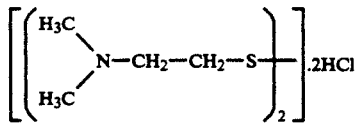

| | |
|---|---|
| Aqueous ammononia (27%) | 15 ml |
| Water to make | 1.0 l |
| pH | 6.3 |
| Bleach-fixing solution | |
| Fe(III)ammonium ethylenediaminetetraacetate dihydsate | 50.0 |
| Disodium ethylenediaminetetraacetate | 5.0 |
| Sodium sulfite | 12.0 |
| Ammonium sulfite aqueous solution (70%) | 240.0 ml |
| Aqueous ammononia (27%) | 6.0 ml |
| Water to make | 1.0 l |
| pH | 7.2 |
| Washing solution | |
| Tap water treated by passage through a hybrid-type column filled with an H-type strong acid cation-exchange resin (Amberlite IR-120B, made by Rohm & | |

-continued

| | (gram) |
|---|---|
| Haas) and an OH-type strong alkaline anion-exchange resin (Amberlite IR-400, made by Rohm & Haas) to obtain each concentration of calcium ions and magnesium ions being 3 mg/l or below and added 20 mg/l of sodium dichloroisocyanurate and 0.15 g/l sodium sulfate. The pH of this solution was in a range of 6.5 to 7.5. | |
| Stabilizing solution | |
| Formalin (37%) | 2.0 ml |
| Polyoxyethylene-p-monomonyl phenyl ether (average polimerization degree: 10) | 0.3 |
| Disodium ethylenediaminetetraacetate | 0.05 |
| Water to make | 1.0 l |
| pH | 5.0 to 8.0 |

EXAMPLE 4

Absorption diagrams of solution of azomethine dye (D-1) obtained from the coupler (1) of the present invention and solution of indoaniline dye (D-2) obtained from comparative coupler (R-1) are shown in FIG. 1. It can be noticed that the decrease of subsidiary absorption at 400 to 450 nm and sharpness of main absorption are attained.

(D-1)

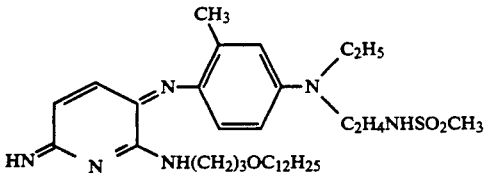

(D-2)

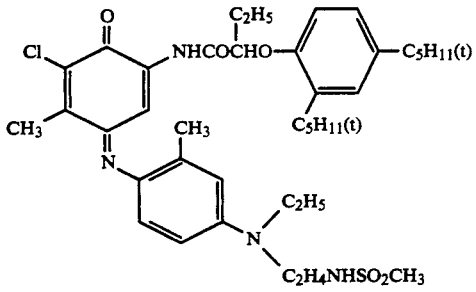

Having described our invention as related to the embodiment, it is our intention that the invention not be limited by any of the details of the description, unless otherwise specified, but rather be construed broadly within its spirit and scope as set out in the accompanying claims.

What we claim is:

1. A silver halide color photographic material which comprises at least one dye-forming coupler represented by formula (II)

Formula (II)

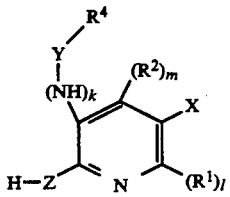

wherein H—Z— represents an unsubstituted amino group or an aliphatic amino, aromatic amino, or heterocyclic amino group, which may be substituted, $R^1$ and $R^2$ each represent an electron-donating group, l and m each are 0 or 1, provided that $l+m \geqq 1$, k is 0 or 1, Y represents —CO— or $SO_2$—, $R^4$ represents an aliphatic group, an aromatic group, a heterocyclic group, an amino group, an aliphatic amino group, an aromatic amino group, an aliphatic oxy group, or an aromatic oxy group, and X represents a hydrogen atom, a halogen atom, an aliphatic or aromatic oxy group, an aliphatic or aromatic thio group, an aliphatic or aromatic oxycarbonyloxy group, an aliphatic or aromatic carbonyloxy group, or an aliphatic or aromatic sulfonyloxy group that is capable of being released upon a coupling reaction with the oxidized product of a developing agent.

2. The silver halide color photographic material as claimed in claim 1, wherein the dye-forming coupler represented by formula (II) is contained in a photosensitive silver halide emulsion layer of the silver halide color photographic material.

3. The silver halide color photographic material as claimed in claim 1, wherein the dye-forming coupler represented by formula (II) is contained $1\times10^{-3}$ to 1 mol per mol of silver halide.

4. The silver halide color photographic material as claimed in claim 1, wherein, when the silver halide color photographic material is a color negative film or a color reversal photographic material that contains, in its photographic emulsion layer, silver bromochlorobromide, silver chloroiodide, or silver bromoiodide comprising about 30 mol % or below of silver iodide.

5. The silver halide color photographic material as claimed in claim 1, wherein the silver halide color photographic material is a color photographic paper that contains in its photographic emulsion layer, silver chlorobromide or silver chloride being substantially free from silver iodide.

6. The silver halide color photographic material as claimed in claim 5, wherein the silver halide emulsion comprises 98 to 100 mol % of silver chloride.

7. The silver halide color photographic material as claimed in claim 1, wherein the silver halide color photographic material is a direct positive color photographic material that contains, in it photographic emulsion layer, silver chlorobromide or silver chloride.

8. The silver halide color photographic material as claimed in claim 1, wherein the silver halide color photographic material is a negative photographic material for photographing wherein the total layer thickness of all the hydrophilic colloid layers on the side having emulsion layers in 28 μm or below.

9. The silver halide color photographic material as claimed in claim 1, wherein H—Z— in formula (II) represents an aliphatic amino group, an aromatic amino group, or a heterocyclic amino group wherein said aliphatic, aromatic or heterocyclic moiety is substituted by a group or an atom selected form the group consisting of an alkoxy group, an aryloxy group, an alkenyloxy group, an amino group, an acyl group, an ester group, an amido group, a sulfamido group, an imido group, a ureido group, an aliphatic sulfonyl group, an aromatic sulfonyl group, an aliphatic thio group, an aromatic thio group, a hydroxyl group, a cyano group, a carboxy group, a nitro group, and a halogen atom.

10. The silver halide color photographic material as claimed in claim 1, wherein at least one of $R^1$ and $R^2$ in formula (II) represents a substituent having a Hammett's substituent constant value $\sigma_p$ of −0.25 or below.

11. The silver halide color photographic material as claimed in claim 1, wherein H—Z— is an aliphatic amino group having 1 to 36 carbon atoms, an aromatic amino group having 6 to 36 carbon atoms, or a 5- to 7-membered heterocyclic amino group.

12. The silver halide color photographic material as claimed in claim 1, wherein $R^4$ represents an aliphatic group having 1 to 36 carbon atoms, an aromatic group having 6 to 36 carbon atoms, or a 5- to 7-membered heterocyclic group.

13. The silver halide color photographic material as claimed in claim 1, wherein $R^4$ represents an unsubstituted or substituted phenyl, alkyl, alkylamino or phenylamino group.

14. The silver halide color photographic material as claimed in claim 1, wherein m is 0 and 1 is 1.

15. The silver halide color photographic material as claimed in claim 1, in which l is formula (II) is 1.

16. The silver halide color photographic material as claimed in claim 1, in which m is formula (II) is 0.

17. A silver halide color photographic material which comprises at least one dye-forming coupler represented by formula (I)

Formula (I)

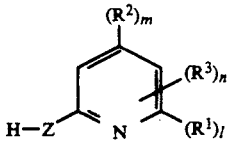

wherein H—Z— represents na unsubstituted amino group or an aliphatic amino, aromatic amino, or heterocyclic amino group, which may be substituted, $R^1$ and $R^2$ each represent an electron-donating group, $R^3$ represents an aliphatic group having 1 to 36 carbon atoms, an aromatic group having 6 to 36 carbon atoms, or a 5- to 7-membered heterocyclic group, l and m each are 0 or 1, provided that $l+m \geqq 1$, and n is an integer of 0 to 2.

18. A silver halide color photographic material which comprises at least one dye-forming coupler represented by formula (I)

Formula (I)

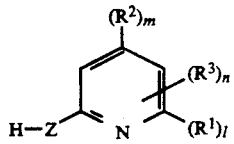

wherein H—Z— represents an unsubstituted amino group or an aliphatic amino, aromatic amino, or heterocyclic amino group, which may be substituted, $R^1$ and $R^2$ each represent an electron-donating group, $R^3$represents a substituted or unsubstituted phenyl group, an alkyl group, an alkylamino group or a phenylamino group, l and m each are 0 or 1, provided that $l+m \geqq 1$, and n is an integer of 0 to 2.

* * * * *